US005680654A

United States Patent [19]

McClanahan, II

[11] Patent Number: 5,680,654

[45] Date of Patent: Oct. 28, 1997

[54] SMOKER'S GLOVE

[76] Inventor: James R. McClanahan, II, 1433 Ramblewood Rd., Apt. 101, Norfolk, Va. 23513

[21] Appl. No.: 681,559

[22] Filed: Jul. 23, 1996

[51] Int. Cl.[6] ..... A41D 19/00

[52] U.S. Cl. ..... 2/163; 2/159

[58] Field of Search ..... 2/163, 162, 159

[56] References Cited

U.S. PATENT DOCUMENTS

| | | | |
|---|---|---|---|
| 1,358,824 | 11/1920 | Burden | 2/163 |
| 2,103,594 | 12/1937 | Murray | 2/160 |
| 2,118,463 | 5/1938 | Eden | 2/163 |
| 2,253,710 | 8/1941 | Jones et al. | 2/163 |
| 2,513,030 | 6/1950 | Lazarian | 2/163 |
| 4,164,043 | 8/1979 | Fujita . | |
| 5,276,922 | 1/1994 | Floyd, Jr. . | |
| 5,330,391 | 7/1994 | Mitchell . | |

FOREIGN PATENT DOCUMENTS

| | | | |
|---|---|---|---|
| 750292 | 2/1933 | France | 2/163 |
| 975328 | 11/1948 | France | 2/163 |

*Primary Examiner*—Bibhu Mohanty
*Attorney, Agent, or Firm*—Thedford Hitaffer

[57] ABSTRACT

A glove capable of selectively covering and exposing at least a tip portion of a wearer's first and second fingers while the glove is being worn by the wearer. The first and second fingers of the glove are each provided with a slit through which a wearer's first and second fingers may be removed without removing the glove. Although the first and second fingers of the glove are removable from the wearer's first and second fingers, the first and second fingers of the glove remain integral with the rest of the glove. For at least this reason, the glove is provided with a pouch which is structured and configured to store the first and second fingers of the glove out of the wearer's way when the wearer's first and second fingers are not being covered by the first and second fingers of the glove. When the wearer's first and second fingers are being covered by the first and second fingers of the glove, the slit is covered by a removable flap to ensure that the wearer's first and second fingers remain covered. The glove is particularly suitable for, but is not limited to, use by smokers. The glove according to the instant invention permits the wearer to hold a lit cigarette between certain of his fingers while wearing the glove without compromising the glove.

20 Claims, 3 Drawing Sheets

SMOKER'S GLOVE

BACKGROUND OF THE INVENTION

1. Field of the Invention

The present invention relates generally to gloves and more particularly, to a glove which is capable of selectively covering or rendering exposed certain fingers of the wearer's hand.

2. Description of the Prior Art

Gloves are well known in the prior art and gloves exposing the wearer's fingers are not uncommon. For example, U.S. Pat. No. 4,164,043, issued Aug. 14, 1979, to Satoru Fujita, shows and describes a fingerless glove which completely exposes each of the wearer's fingers as well as the wearer's thumb. A glove similar to Fujita's glove is set forth in U.S. Pat. No. 5,276,922, issued Jan. 11, 1994, to George M. Floyd, Jr. Floyd's glove is similar to Fujita's glove in that Floyd's glove exposes the wearer's fingers as well as the wearer's thumb. Unlike the glove of Fujita, however, Floyd's glove exposes only a portion of the wearer's fingers and thumb. A glove similar to Floyd's glove is set forth in U.S. Pat. No. 5,330,391, issued Jul. 19, 1994, to Kenneth R. Mitchell. Mitchell's glove is similar to Floyd's glove in that Mitchell's glove exposes only a portion of the wearer's fingers. Unlike Floyd's glove, however, Mitchell's glove exposes only certain fingers of the wearer, covering the remaining fingers completely.

It should be noted that none of the foregoing gloves, taken either singly or in combination, is seen to describe the instant invention as claimed.

SUMMARY OF THE INVENTION

The instant invention relates to a glove which selectively covers or exposes at least a portion of certain fingers of the wearer's hand. The glove is uniquely structured and configured to expose the wearer's fingers without removing the glove from the wearer's hand. Such a glove is particularly suitable for use by smokers because the glove protects the wearer's hand while permitting the wearer to hold a cigarette without compromising the glove.

The glove according to the instant invention includes a principal portion which covers the wearer's palm and the back side of the wearer's hand, fingers which cover the wearer's fingers, and a thumb which covers the wearer's thumb. The first and second fingers of the glove are provided with openings through which the wearer's fingers may be removed to expose the wearer's fingers. A releasable fastener is provided which permits the wearer to cover openings.

The glove also includes a pouch which is integral with the principal portion of the glove. The pouch is provided for conveniently receiving and storing the first and second fingers of the glove when these fingers are not in use.

The first and second fingers of the glove further include inner layers which cover the lower portions of the wearer's first and second fingers. When the first and second fingers of the glove are not in use, the inner layers cover the lower portions of the wearer's first and second fingers while the remainder of the wearer's first and second fingers are exposed to permit the user to hold a lit cigarette without compromising the glove.

The glove of the instant invention provides an advantage over the gloves in the prior art of record in that the glove of the instant invention selectively covers or exposes certain fingers of the wearer's hand. Moreover, the glove provides an advantage over the prior art in that certain fingers of the wearer's hand are selectively covered or exposed without removing the glove from the wearer's hand.

Accordingly, it is a principal object of the instant invention to provide a glove which selectively covers or exposes certain fingers of the wearer's hand without removing the glove from the wearer's hand.

It is another object to provide a glove that is particularly suitable for use by smokers by permitting smokers to hold a lit cigarette while wearing the glove without compromising the glove.

It is yet another object to provide a glove which includes a principal portion which covers the wearer's palm as well as the back side of the wearer's hand, fingers which cover the wearer's fingers, and a thumb which covers the wearer's thumb.

It is still another object that the first and second fingers of the glove include a releasably fastenable opening through which the wearer's fingers may be removed.

Another object is that the glove be structured and configured to store the first and second fingers of the glove when not in use.

Yet another object is that the first and second fingers of the glove include inner layers which cover the lower portions of the wearer's first and second fingers when the first and second fingers of the glove are not in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
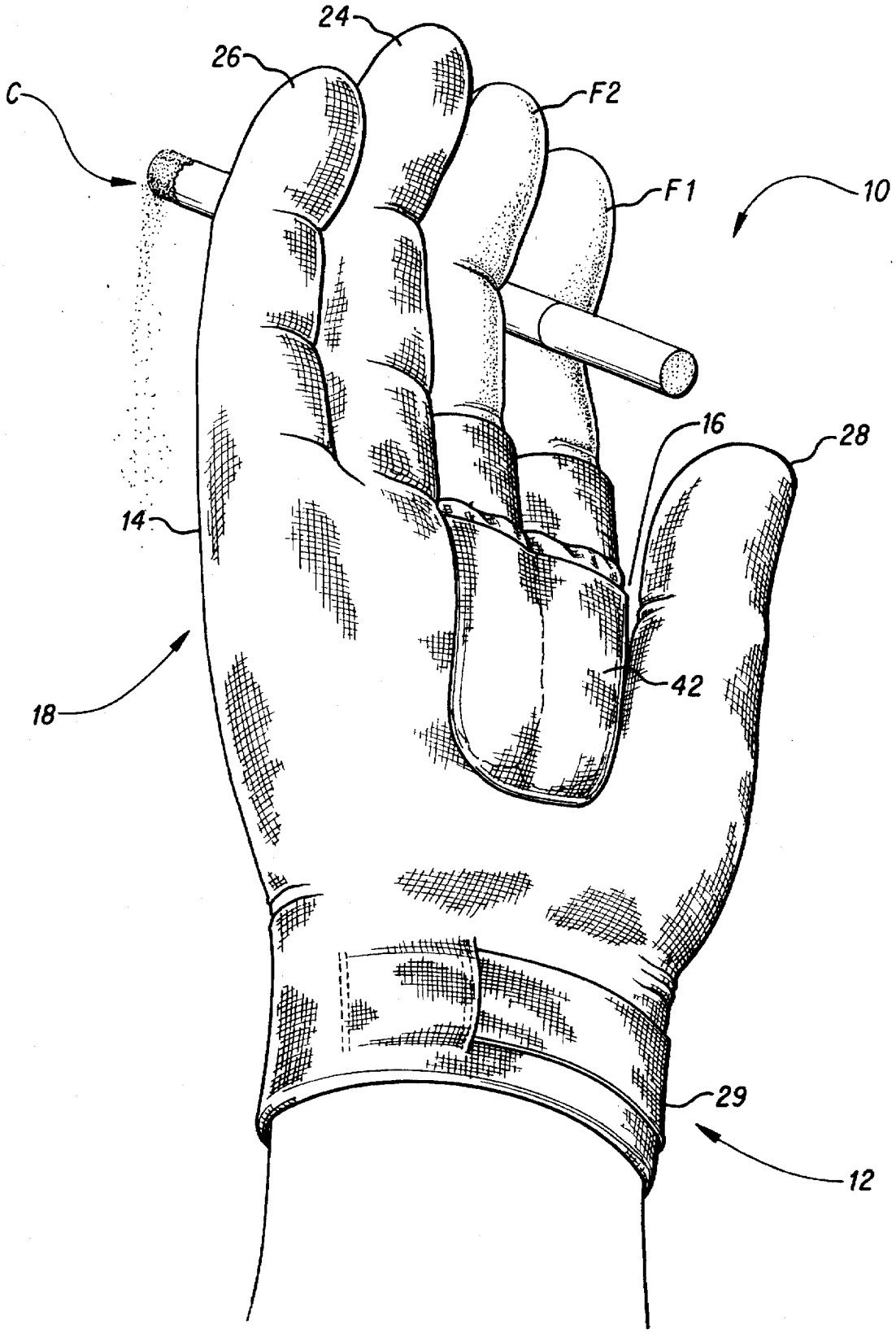
FIG. 1 is an environmental perspective view of the palm side of a glove according to the instant invention.
Figure 2:
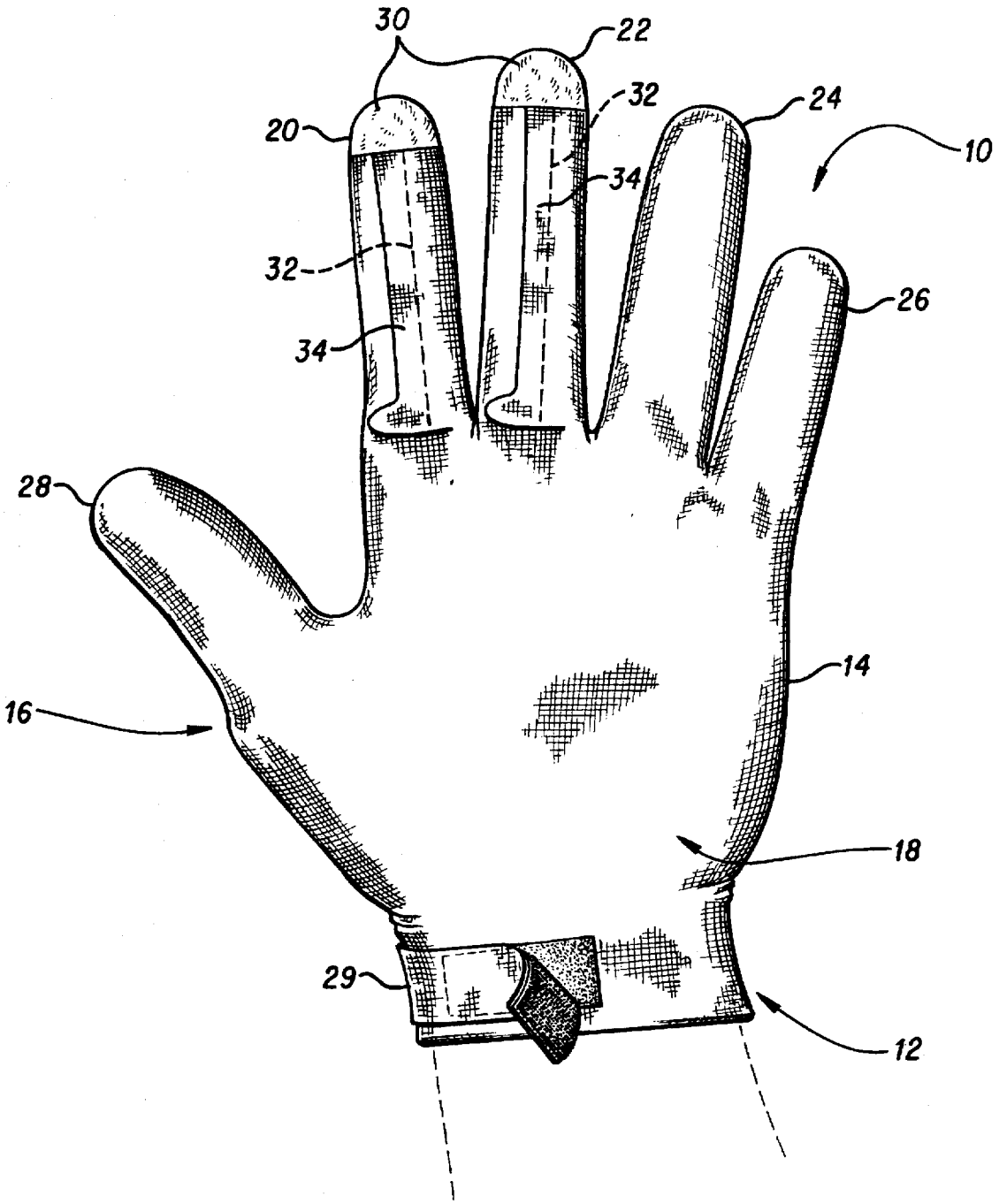
FIG. 2 is a plan view of the backside of the glove shown in FIG. 1, showing the openings in the first and second finger portions of the glove in hidden lines.

As shown in FIGS. 1 and 2, the present invention is a glove 10 which selectively covers or renders exposed the first and second fingers of the wearer. The glove 10 includes a wrist encircling portion 12, a principal portion 14 which includes a palm side 16 and a back side 18, four fingers 20, 22, 24, 26 and a thumb 28. The wrist encircling portion 12 is integral with the principal portion 14 and is provided with a tightening strap 29 for tightening the wrist encircling portion 12 about the wearer's wrist. The thumb 28 of the glove 10 and each of the glove fingers 20, 22, 24, 26 are attached to the principle portion 14 so as to form the shape of a hand.

Figure 3:
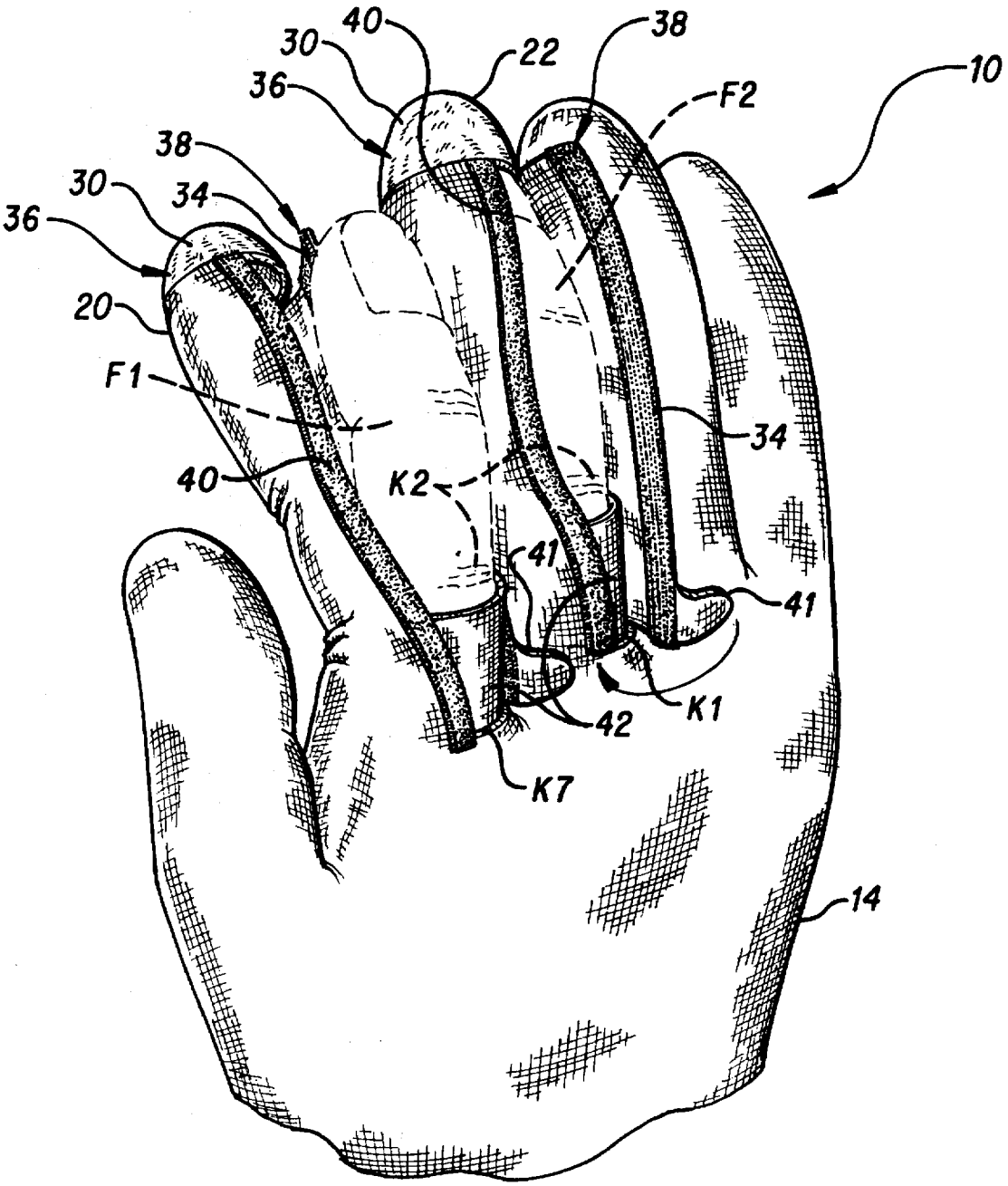
FIG. 3 is a partial environmental perspective view of the glove showing the openings in the back side of the first and second finger portions of the glove in an opened position with the wearer's first and second fingers partly removed.

As shown in FIG. 3, the first and second fingers 20, 22 of the glove 10 are provided with openings through which the wearer's first and second fingers may pass. These openings permit the wearer's first and second fingers to be removed from the first and second fingers 20, 22 of the glove 10 without removing the glove 10 from the wearer's hand. One manner in which these openings may be provided is shown clearly in FIGS. 2 and 3. The first and second fingers 20, 22 of the glove 10 may each include a hemispherical tip 30 and a longitudinal slit 32 which extends from the hemispherical tip 30 to the principal portion 14 of the glove 10. The slits 32 in the first and second finger 20, 22 of the glove 10 each define the opening through which the wearer's corresponding first and second fingers F1, F2 may pass. It is this unique structure and configuration of these openings which permits the wearer's first and second fingers F1, F2 to be removed from the first and second fingers 20, 22 of the glove 10 without removing the glove 10 from the wearer's hand.

The slits 32 in the first and second fingers 20, 22 of the glove 10 may be held in a closed position a longitudinal flap 34 that extends the length of slit 32 so as to cover the slit 32 entirely. These flaps 34 may be held in a closed position over the slits 32 by releasable fasteners, such as the hook and loop type fasteners 36 shown. The hook elements 38 may be in the form of longitudinal strips attached to the first and second fingers 20, 22 of the glove 10 adjacent the slits 32. The loop elements 40 may be in the form of longitudinal strips attached to the flaps 34 of the first and second fingers 20, 22 of the glove 10. As shown in FIG. 2, the loop elements 40 are matingly engagable with the hook elements 38 to hold the slits 32 in a tightly closed position while covering the slits 32 and thus fully and completely covering the wearer's first and second fingers F1, F2. A one-quarter inch or seven millimeter (mm) overlap for the flaps 40 is sufficient to accommodate the hook and loop type fastener 36.

The flaps 34 may be provided with tabs 41 that may be readily and easily grasped by the wearer to permit the wearer to effortlessly open the flaps 34 to expose the slits 32 and permit the removal of the wearer's first and second fingers F1, F2.

As shown in FIGS. 1 and 3, when the wearer's first and second fingers F1, F2 are not covered by the first and second fingers 20, 22 of the glove 10, an inner layer 42 continues to cover at least the lower portions of the wearer's first and second fingers F1, F2. The inner layer 42 extends between the first and second knuckles K1, K2 of the wearer's first and second fingers F1, F2 to cover the lower portion of the wearer's first and second fingers F1, F2 while rendering the remainder of the wearer's first and second fingers F1, F2 exposed. The wearer may hold a lit cigarette C between the exposed portions of his first and second fingers F1, F2 without compromising the glove 10.

When the fingers 20, 22 of the glove 10 are not functioning to cover the wearer's fingers F1, F2, the first and second fingers 20, 22 of the glove 10 may be stored out of the wearer's way. This may be accomplished by providing the glove 10 with a pouch 42 for receiving the first and second fingers 20, 22 of the glove 10. As shown in the drawings, the pouch 42 may be integral with the palm side 16 of the glove 10. As is clearly shown in FIG. 1, when the wearer's first and second fingers F1, F2 are removed from the first and second fingers 20, 22 of the glove 10, the first and second fingers 20, 22 of the glove 10 may be folded downward and inward toward the palm of the wearer's hand and may be inserted into the pouch 42 located on the palm side 16 of the glove 10 to store the first and second fingers 20, 22 of the glove 10 out of the wearer's way. It should be noted that the first and second fingers 20, 22 of the glove 10 remain integral with the principal portion 14 of the glove 10 and the pouch 42 provides a convenient storage place for the first and second fingers 20, 22 of the glove 10 when the first and second fingers 20, 22 of the glove 10 are not in use.

It is to be understood that the present invention is not limited to the sole embodiment described above, but encompasses any and all embodiments within the scope of the following claims.

I claim:

1. A glove comprising:

a wrist encircling portion, a principal portion having a palm side and a back side, said principal portion being integral with said wrist encircling portion, a plurality of permanently attached finger portions each for covering a finger, said plurality of finger portions being attached to said principal portion, said plurality of finger portions including at least a first finger portion and a second finger portion, said first and second finger portions each including an opening through which a wearer's first and second fingers may pass, a first and second inner layer each extending a predetermined distance from said principal portion and beneath said finger portions so as to encircle a lower portion of a wearer's first and second fingers, and a thumb portion, said thumb portion being attached to said principal portion of said glove.

2. A glove according to claim 1, wherein said wrist encircling portion includes a tightening strap.

3. A glove according to claim 1, wherein said first and second finger portions are structured and configured to selectively fasten said opening in a closed position and unfasten said opening from the closed position.

4. A glove according to claim 1, wherein said first and second finger portions each include a hemispherical tip, said opening in said first and second finger portions being defined as a longitudinal slit extending from said hemispherical tip to said principal portion of said glove.

5. A glove according to claim 4, wherein said first and second finger portions each include a longitudinal flap extending the length of said slit.

6. A glove according to claim 5, wherein said first and second finger portion each further include a fastener releasably fastening said flaps on said first and second finger portions over said slits in said first and second finger portions.

7. A glove according to claim 6, wherein said fastener on said first and second finger portions each includes a hook and loop type fastener, said hook and loop type fasteners each including a hook element attached to a corresponding second first and second finger portions of the glove adjacent said slit therein and a loop element attached to a corresponding one of said flaps of the first and second finger portions, whereby said loop elements are matingly engagable with said hook elements to hold said slits in said first and second finger portions in a tightly closed position coveting said slits.

8. A glove according to claim 1, further including a pouch integral with said principal portion of said glove for receiving said first and second finger portions.

9. A glove according to claim 8, wherein said pouch is attached to said palm side of said principal portion of said glove.

10. A glove comprising:

a wrist encircling portion, a principal portion integral with said wrist encircling portion, said principal portion having a palm side and a back side, a plurality of permanently attached, finger portions attached to said principal portion, said plurality of finger portions including at least a first finger portion and a second finger portion each for covering a finger, said first and second finger portions each including a longitudinal slit through which a wearer's first and second fingers may pass, a first and second inner layer each extending a predetermined distance from said principal portion and beneath said finger portions so as to encircle a lower portion of a wearer's first and second fingers, and a thumb portion attached to said principal portion.

11. A glove according to claim 10, wherein said wrist encircling portion includes a tightening strap.

12. A glove according to claim 10, wherein said first and second finger portions each further include a longitudinal flap dimensioned and configured to overlap said slit.

13. A glove according to claim 12, wherein said first and second finger portions each further include a fastener releasably fastening said flaps on said first and second finger portions over said slits in said first and second finger portions.

14. A glove according to claim 13, wherein said fastener includes a hook and loop type fastener.

15. A glove according to claim 10, further including a pouch integral with said principal portion of said glove for receiving said first and second finger portions.

16. A glove according to claim 15, wherein said pouch is attached to said palm side of said principal portion of said glove.

17. A glove comprising:

a wrist encircling portion, a principal portion integral with said wrist encircling portion, said, principal portion having a palm side and a back side, a plurality of permanently attached finger portions attached to said principal portion, said plurality of finger portions having a palm side and a back side corresponding to said palm side and said back side of said principal portion, said plurality of finger portions further including at least a first finger portion and a second finger portion, said first and second finger portions each including a longitudinal slit along said back side thereof through which a wearer's first and second fingers may pass and a longitudinal flap dimensioned and configured to selectively expose and overlap said slit, a first and second inner layer each extending a predetermined distance from said principal portion and beneath said finger portions so as to encircle a lower portion of a wearer's first and second fingers, a pouch integral with said palm side of said principal portion of said glove, said pouch having an opening adjacent said first and second finger portions for receiving said first and second finger portions into said pouch, said a thumbs portion attached to said principal portion of glove.

18. A glove according to claim 17, wherein said wrist encircling portion includes a tightening strap.

19. A glove according to claim 17, wherein said first and second finger portions each further include a fastener releasably fastening said flaps on said first and second finger portions over said slits in said first and second finger portions.

20. A glove according to claim 19, wherein said fastener includes a hook and loop type fastener.

* * * * *